United States Patent [19]

Greco et al.

[11] 4,442,632

[45] Apr. 17, 1984

[54] WINDOW REGULATOR, PARTICULARLY FOR MOTOR VEHICLES

[75] Inventors: Claudio Greco, Rivoli; Gianfranco Fiorito, Nichelino, both of Italy

[73] Assignee: IAO Industrie Riunite S.p.A., Italy

[21] Appl. No.: 327,048

[22] Filed: Dec. 3, 1981

[51] Int. Cl.[3] ..... E05F 11/48

[52] U.S. Cl. ..... 49/352; 49/360

[58] Field of Search ..... 49/352, 360, 349, 362

[56] References Cited

U.S. PATENT DOCUMENTS

| | | | |
|---|---|---|---|
| 3,219,335 | 11/1965 | Burridge | 49/360 |
| 3,427,748 | 2/1969 | Marr | 49/352 |
| 3,930,339 | 1/1976 | Jander | 49/352 |
| 4,109,417 | 8/1978 | Fogarollo | 49/352 |

FOREIGN PATENT DOCUMENTS

| | | | |
|---|---|---|---|
| 2029895 | 3/1980 | United Kingdom | 49/360 |

*Primary Examiner*—Philip C. Kannan

*Attorney, Agent, or Firm*—James B. Raden; Marvin M. Chaban

[57] ABSTRACT

A regulator for the window of a motor vehicle in which a rail rigidly connectable to a mobile window is movable in a primary path along a guide as driven by an actuator mechanism. The rail is coupled to the mechanism by way of two slides of which the first slide is coupled to said guide in order to translate the window along this guide in a manner allowing limited angular movement about the guide. The second slide is coupled to the first slide in a manner allowing translatory movement of the window in a secondary direction substantially perpendicular to the guide.

6 Claims, 5 Drawing Figures

9
25
36
24
23
19
17
20
22
36
11
28
32
25
27
35
30
34
32
32
36
33
31
29
27
38
39
38
39
36
12
36
24
26
23
18
19
22
21

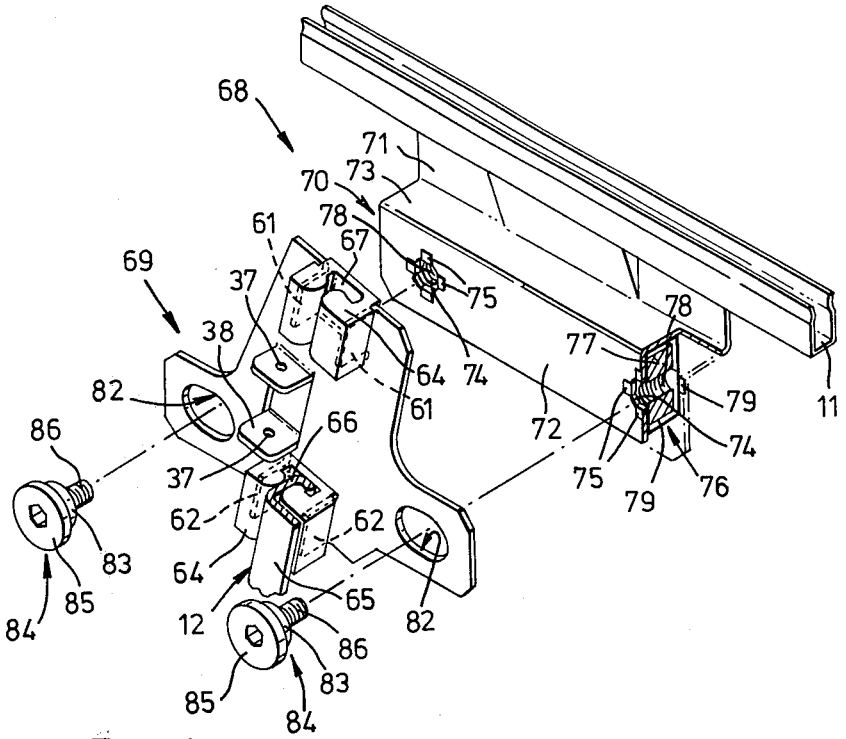
Fig. 4.
Fig. 5.
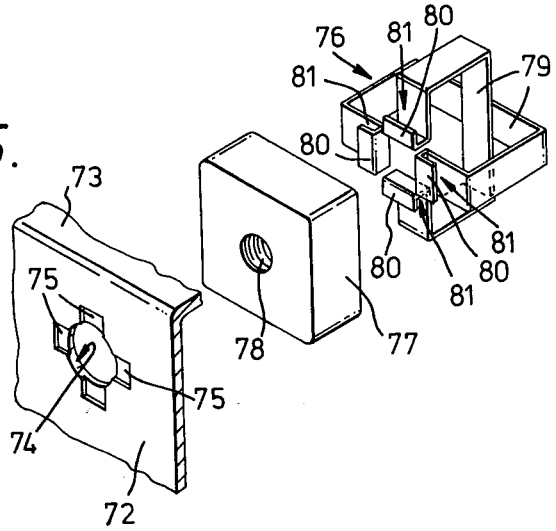

WINDOW REGULATOR, PARTICULARLY FOR MOTOR VEHICLES

BACKGROUND OF THE INVENTION

This invention relates to a window regulator particularly for motor vehicles.

In particular, this invention relates to a window regulator particularly suitable for mounting inside a motor vehicle door in order to control the position of a mobile window thereof.

The window regulator of the present invention is of the type comprising a guide mounted in a fixed position inside said door, and a rail or another similar support mounted slidable along said guide under the thrust of actuator means and connectable to a lower edge of said window.

SUMMARY OF THE INVENTION

The window regulator of the present invention has been designed with the object of enabling said rail to carry out, relative to said guide and in addition to said sliding movement, a series of further movements able to compensate for any structural defects or imperfections in said door, said further movements not being attainable in the case of known window regulators of the same type.

The present invention provides a window regulator particularly for motor vehicles, comprising a support member rigidly connectable to a mobile window and movable along a guide under the thrust of operating means, characterised in that said support member is coupled to said guide by way of a first and a second slide, said first slide being coupled to said guide in order to translate along it under the thrust of said operating means and being angularly free with respect to said guide; and said second slide being supported by said first slide; coupling means being disposed between said two slides to enable said second slide to translate freely relative to the first in a direction substantially transverse to said guide and parallel to said window.

Further characteristics and advantages of the present invention will be apparent from the description given hereinafter with refernece to the accompanying drawings which show some non-limiting embodiments thereof, and in which:

BRIEF DESCRIPTION OF THE DRAWINGS

FIG. 4 is a partly sectional exploded perspective view of a modification of the detail of FIG. 3; and FIG. 5 is an exploded perspective view illustrating a detail of FIG. 4 to an enlarged scale.

DETAILED DESCRIPTION

Figure 1:
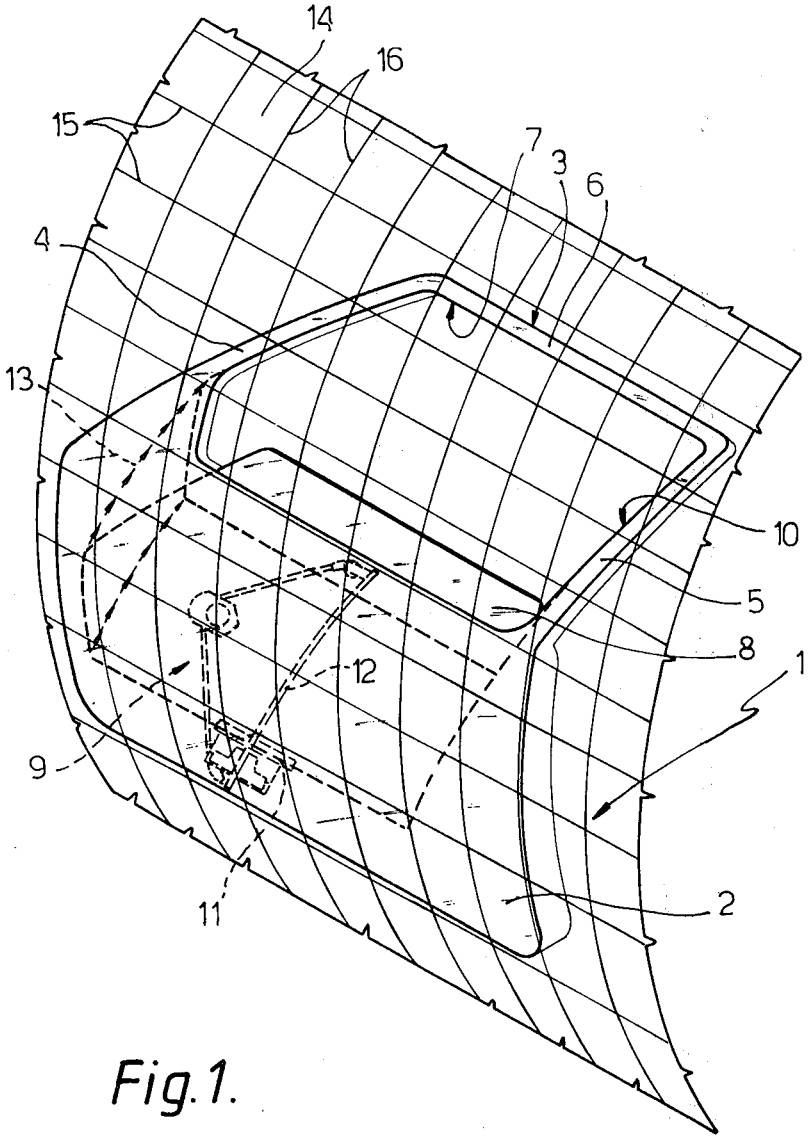
FIG. 1 is a diagrammatic perspective view of a motor vehicle door provided with a window regulator constructed according to the present invention.

FIG. 1 illustrates a motor vehicle door indicated overall by 1 and comprising a lower flat portion 2 and an upper frame 3 which is constituted by a front inclined upright 4, a rear upright 5 and a cross member 6 which together with an upper edge of the lower portion 2 define an aperture 7 closed by a mobile window 8 controlled by a window regulator indicated overall by 9 and housed inside the lower portion 2.

In the example illustrated, the rear edge of the window 8 engages a guide channel 10 extending along the upright 5, and a central portion of the window 8 is rigidly connected, as explained in detail hereinafter, to a support member constituted by a rail 11 mobile along a guide 12 of the device 9 parallel to the channel 10. This latter is parallel to a channel 13 extending inside the lower portion 2 and engaged by the front edge of the window 8. As is well known, and as is the case with the doors of substantially all motor vehicles, the door 1 extends not over a plane surface but over a cylindrical surface graphically represented in FIG. 1 by the cylindrical surface portion 14, the generating lines 15 of which are normally parallel to the upper and lower edges of the aperture 7, but of which the parallels 16 form a determined angle other than zero with the axes of the channels 10 and 13 and of the guide 12.

From the aforegoing, it is apparent that when the window 8 is moved under the thrust of the window regulator 9, its various points travel through trajectories which in theory are constituted by cylindrical spirals. However, in practice such a situation does not always occur because small constructional imperfections or, in the limit, the mere manufacturing tolerances mean that the axes of the channels 10 and 13 and of the guide 12 are not perfectly parallel to each other and/or the cross member 6 is not perfectly parallel to the generating lines 15. Consequently, the actual trajectory followed by each point of the window 8 tends to vary from the relative theoretical cylindrical spiral by small displacements which have a first component substantially parallel to the generating lines 15 and a second component extending in a substantially radial direction to the cylindrical surface 14 and due to the rotation of the window 8 about the axis of the guide 12.

Figure 2:
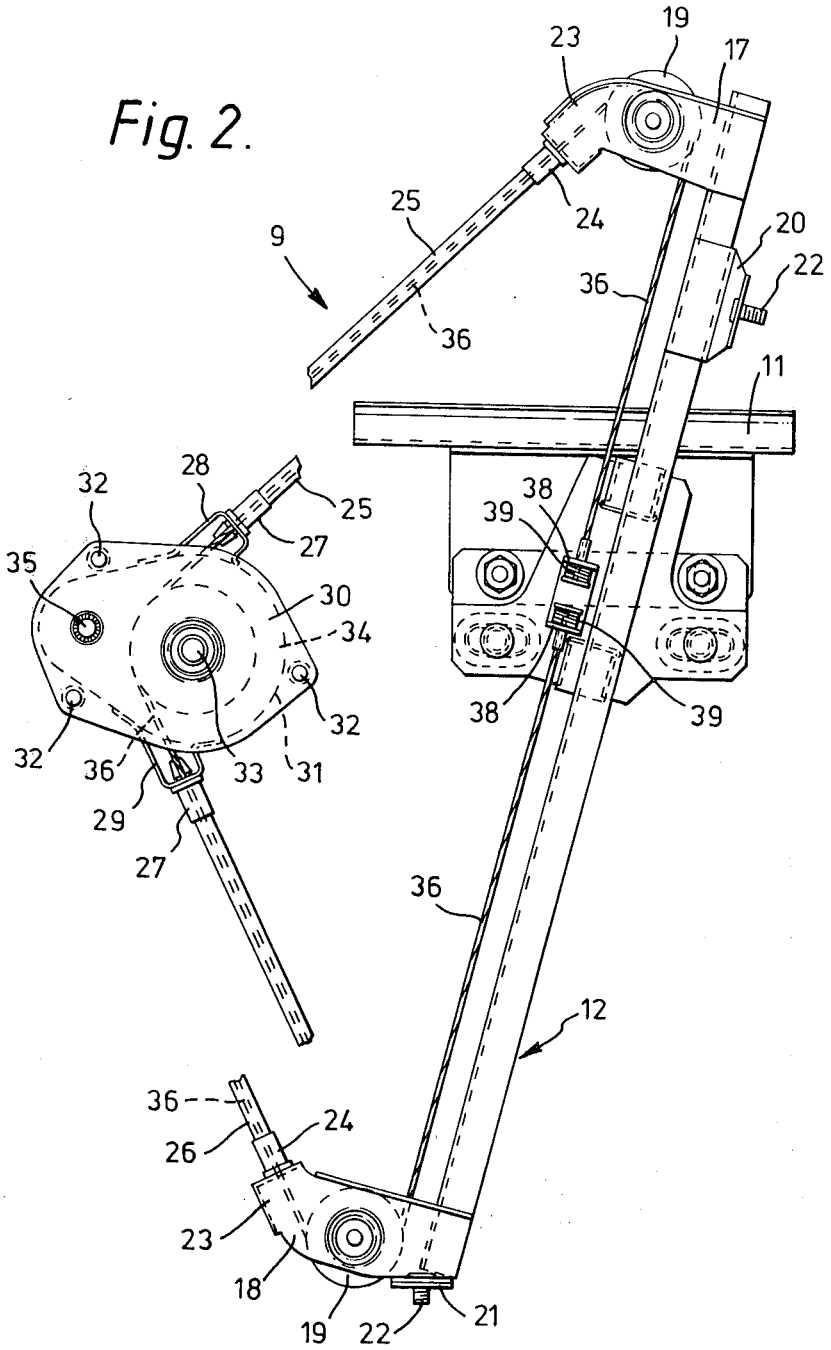
FIG. 2 is a front elevation of the window regulator of FIG. 1 to an enlarged scale.

The window regulator 9 shown in detail in FIG. 2 has been designed for the precise purpose of controlling the raising and lowering of the window 8 without opposing the said small displacements, so as to prevent any undesirable and often considerable stresses arising which reduce its life and make its operation difficult.

As shown in FIG. 2, at its opposing ends the guide 12 comprises two transverse appendices 17 and 18 extending from the same side of the guide 12 and each rotatably supporting a respective pulley 19. The rigid assembly constituted by the guide 12 and appendices 17 and 18 is provided with an upper bracket 20 and a lower bracket 21 each provided with a threaded pin 22 arranged to allow the assembly 12, 17, 18 to be fixed to the lower portion 2 of the door 1.

The appendices 17 and 18 comprise ends 23 frontally coupled to tubular end pieces 24 of respective tubular sheaths 25 and 26, the other ends of which are connected by tubular end pieces 27 to respective appendices 28 and 29 of a box 30. This latter comprises a flange 31 provided with bores 32 arranged for engagement by screws (not shown) for connecting the box 30 to the lower portion 2 of the door 1. The box 30 rotatably supports a pin 33 for supporting a drum 34 controlled by the operation of a drive shaft 35 emerging from the box 30. The drum 34 carries a spirally wound wire 36, preferably of metal, which engages with the tubular sheaths 25 and 26, winds about the pulleys 19 and engages by means of its opposing ends in two bores 37 (FIG. 3) provided through respective brackets 38, said ends being resiliently fixed to the inner surfaces of these latter by respective opposing spiral springs 39.

Figure 3:
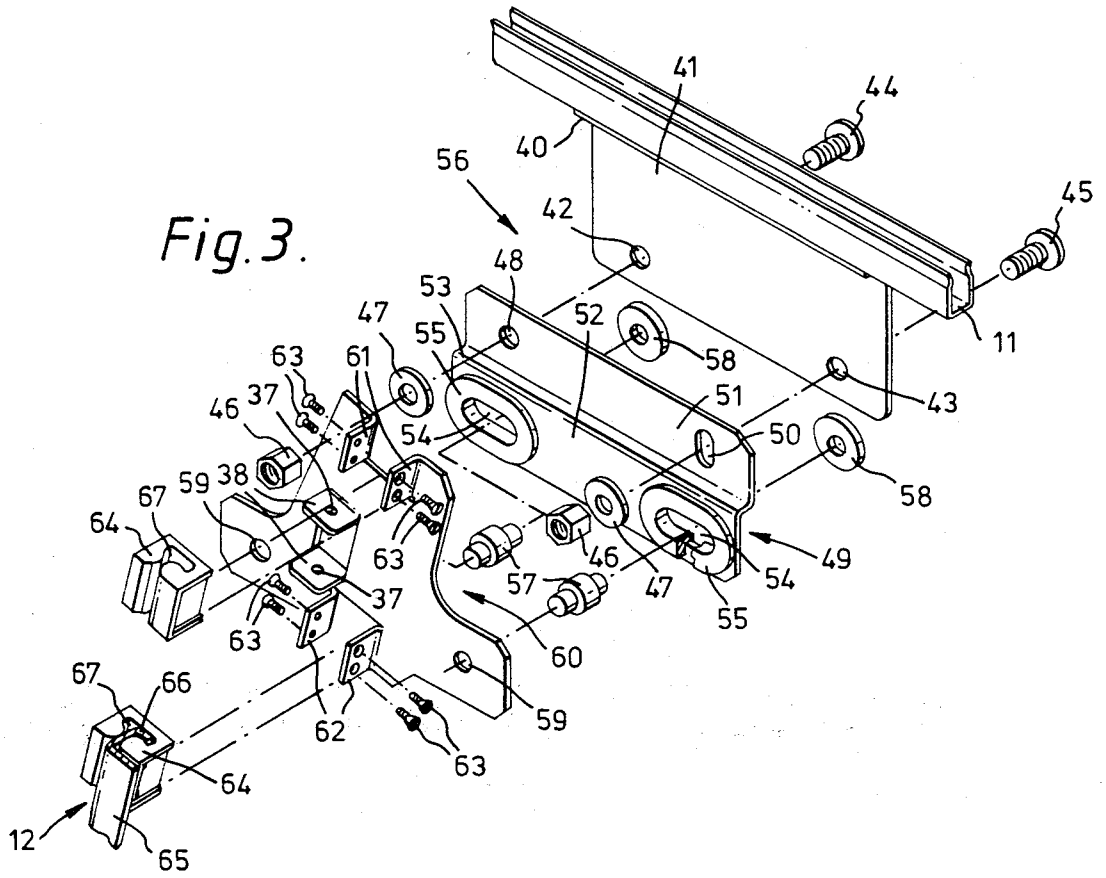
FIG. 3 is an exploded perspective view illustrating a detail of FIG. 2 to an enlarged scale.

As shown in particular in FIG. 3, the rail 11 is constituted by a preferably metal section of substantially U cross-section, which is disposed with its concavity facing upwards to receive in its interior the lower edge of the window 8, to which the rail 11 is rigidly connected, for example by forced clamping and cementing.

The lower wall of the rail 11 is rigidly connected to an upper side flange 40 of a plate 41 substantially coplanar with the window 8, and of substantially rectangular shape, and comprising two through bores 42 and 43 provided in proximity to the lower edge of said plate 41. The bores 42 and 43 are engaged by respective screws 44 and 45, each provided with a respective nut 46 and a respective washer 47, the first extending through the bore 42 and an analogous bore 46 provided through a plate 49, and the second extending through the bore 43 and a slot 50 having its axis perpendicular to the axis of the rail 11 and formed through the plate 49. In plan view, this latter is of substantially rectangular shape, and is divided into two substantially equal strips 51 and 52 by means of a central shoulder 53 parallel to the flange 40 and facing it. The strip 51 is disposed upperly and is provided with the bore 48 and slot 50, while the strip 52 is disposed lowerly and is provided with two slots 54 each surrounded by a respective raised border 55 and disposed with their axes in a direction substantially parallel to that of the generating lines 15 of the cylinder 14, i.e. in a direction substantially transverse to the guide 12 and parallel to the window 8.

The plates 41 and 49 together form a slide 56 slidable in a direction substantially parallel to the generating lines 15 on two clinched pins 57, each of which comprises a central cylindrical portion passing with slight radial slack through the raised border 55 of the relative slot 54, a first end portion clinched into contact with a washer 58 slidably cooperating with a side surface of the raised border 55, and a second end portion fixed by clinching into a respective through bore 59 provided in a slide 60 mounted to slide along the guide 12 and supporting the slide 56.

The slide 60 comprises a plate 61 provided with the bores 59 in which the brackets 38 and two further pairs of brackets 61 and 62 aligned with each other and perpendicular to the brackets 38 are formed by blanking and bending operations. The brackets 61 and 62 comprise threaded through bores engaged by respective screws 63 for fixing to each pair of brackets 61 and 62 a slide block 64 preferably of plastics construction and slidably coupled to the guide 12.

As shown in FIG. 3, the guide 12 is substantially of L shape in cross-section, of which a first flange 65 is substantially flat whereas the second flange 66 has its side edge curved so that it lies above the flange 65. The flange 66 slidably engages a longitudinal slot 67 provided through each slide block 64 and of substantially T shape in cross-section. When viewed in cross-section, the slot 67 comprises an inlet branch communicating with the outside and defined by two opposing convex surfaces cooperating with the opposing surfaces of a flat portion of the flange 66, and a base branch of which a longitudinal flat surface cooperates with the outer convex surface of the curved edge of the flange 66.

In the coupling between the slide blocks 64 and guide 12, the fact that convex surfaces of the former are in contact with flat surfaces of the other and vice versa means that the slide 60 can be compelled to move along the guide 12 but without the slide 60 being angularly locked relative to the guide 12, because such a coupling defines a hinge with its axis coinciding with that of the guide 12.

From the aforegoing, it is apparent that when in use, the slide 60 is free to make small angular movements, together with the slide 56, the rail 11 and the window 8, relative to the door 1 about the axis of the guide 12. Moreover, because of the ability of the pins 57 to slide in the guides constituted by the relative slots 54, the slide 56 is free to make small translation movements, together with the rail 11 and window 8, relative to the door 1 in a direction substantially parallel to the generating lines 15 of the cylindrical surface 14. Finally, because a certain radial slack is necessarily present between the pins 57 and the relative slots 54, the slide 56 is free to make small angular movements, together with the rail 11 and window 8, relative to the door 1 about a radial axis of the cylindrical surface 14.

Thus, summarising, the window 8, although perfectly guided by the guide 12, is free to make small transverse and angular movements relative to this latter, which enable it to substantially compensate for all the normal constructional imperfections present in the doors.

The aforesaid results can also be attained by replacing the slides 56 and 60 with corresponding slides 68 and 69 illustrated in FIG. 4, the component parts of which are indicated by the same reference numerals used for the corresponding parts of the slides 56 and 60.

In contrast to the corresponding slide 56, the slide 68 is constructed in a single piece and is formed from a plate 70 bent to form two parallel strips 71 and 72 of substantially rectangular shape, which are joined together by means of an intermediate strip 73 perpendicular to them. The strip 71 is disposed above the others and is rigidly connected to the lower wall of the rail 11. The lower strip 72 comprises two through bores 74, from the edge of each of which there extend four radial slots 75 provided in that of the surfaces of the strip 72 which is disposed facing the slide 69.

To the rear of the strip 72 and below the strip 73 there are disposed two bushes 76, each of which, as shown in detail in FIG. 5, houses a square nut 77 with a threaded through bore 78 disposed in a position substantially coaxial to the relative bore 74.

Each bush 76 comprises two metal elements 79 disposed in mutually perpendicular planes and each constituted by a metal strip bent in the form of a C, the opposing ends of which are bent outwards to define two lips 80 each arranged to engage a respective slot 75, and two U seats 81 each arranged to receive that part of the strip 72 surrounding the relative bore 74 in order to couple the relative bush 76 and relative nut 77 to the plate 70.

The slide 69 is substantially identical to the slide 60, from which it differs in that in it the bores 59 of the slide 60 are replaced by two elongated slots 82 having their major axis parallel to the rail 11. Each slot 82 is engaged with slight radial slack by an intermediate cylindrical portion 83 of a respective screw 84 comprising a cylindrical head 85 having a diameter greater than that of the portion 83 and such as to prevent it from passing through the relative slot 82, and a threaded shank 86 engaged in the bore 78 of the relative nut 77.

A further difference between the slides 60 and 69 is that in this latter, the slide blocks 64 are not screwed but instead are moulded directly on to the relative pairs of brackets 61 and 62. In this respect, it should be noted that the slide blocks 64 could also be provided on the slide 60 in a like manner.

Within the principle of the invention, numerous modifications can be made to the window regulators described by way of non-limiting example, without leaving the scope of the invention idea.

What we claim is:

1. A regulator for controlling the raising and lowering movement of a window within the door of a motor vehicle within a channel along one margin of a window opening of the vehicle, said regulator including a rigid guide affixed to said door adjacent said window opening and substantially parallel to said channel, a flexible drive cable linearly movable along a path generally parallel to said guide and externally thereof for raising and lowering said window, a first slide member secured to said window for movement therewith, a second slide member resiliently secured to said cable and tracked to said guide for movement therealong under control of said cable, said second slide member constrained to linear motion along said guide and means for connecting said first and second slide members to couple said members together for movement of said window in response to movement of the cable, said connecting means enabling a controlled amount of transverse movement between said slide members during raising and lowering movement of said window, means confining transverse movement to a direction generally transverse to the direction of said channel, and means coupling said second slide member to said guide to allow hinge motion of the member about the guide.

2. A regulator as claimed in claim 1, in which there are two slide blocks apart along said guide with a similarly shaped slot in each of said blocks, and in which said slot has one section closely confined about said guide to act as a hinge for said slide block angular movement.

3. A regulator as claimed in claim 1, in which said connecting means comprises a lost motion connection between said slide blocks including a transversely elongated slot in one of said blocks.

4. A regulator as claimed in claim 1, in which the coupling of said cable to said second block comprises a spring biased connection for maintaining said cable taut.

5. A regulator as claimed in claim 1, in which said guide comprises a generally L shaped bracket, and in which there is at least one slide block on said second slide member for said tracking to said guide, said tracking comprising a slot in said slide block for receiving the said guide, said slot including a section oversized considerably greater than the thickness of said guide to allow angular movement between said second slide member and said guide.

6. A regulator as claimed in claim 5, in which said slot in said slide block includes convex walls disposed about said guide to define said hinge coupling about an axis corresponding to that of said guide.

* * * * *